US006076210A

United States Patent [19]

Wu

[11] Patent Number: 6,076,210

[45] Date of Patent: Jun. 20, 2000

[54] MECHANIZED FOLDABLE BED

[75] Inventor: Jack Wu, Taipei, Taiwan

[73] Assignee: Modas Shing Company, Taipei, Taiwan

[21] Appl. No.: 09/311,295

[22] Filed: May 14, 1999

[51] Int. Cl.[7] ..... A61G 7/015; A61G 7/018

[52] U.S. Cl. ..... 5/618; 5/616; 5/174

[58] Field of Search ..... 5/618, 616, 617, 5/613, 174

[56] References Cited

U.S. PATENT DOCUMENTS

| | | | |
|---|---|---|---|
| 4,349,924 | 9/1982 | Zur | 5/618 |
| 4,821,351 | 4/1989 | Barganwall | 5/618 |
| 5,245,718 | 9/1993 | Krauska | 5/618 |

*Primary Examiner*—Alexander Grosz
*Attorney, Agent, or Firm*—Bacon & Thomas, PLLC

[57] ABSTRACT

A mechanized foldable bed is disclosed. The foldable bed has a front frame assembly and a rear frame assembly pivotal with respect to the front frame assembly. A motor is securely mounted under the bed, a driving rod is driven by the motor, a first connecting rod is pivotally connected with the driving rod and a second connecting rod is pivotally connected with the first connecting rod. A tube securely mounted under the bed is for receiving the second connecting rod therethrough. Furthermore, due to a first connector securely connected with the front frame assembly and pivotally connected with the driving rod and a second connector pivotally between the rear frame assembly and the second connecting rod, the torso and legs of a patient are supported simultaneously.

3 Claims, 7 Drawing Sheets

MECHANIZED FOLDABLE BED

BACKGROUND OF THE INVENTION

1. Field of the Invention

The present invention relates to a mechanized foldable bed, and more particularly to the structure that provides substantial support to a user lying on the bed. The structure uses a single motor and a series of linkages pivotally connected with the motor so as to simultaneously provide support to the torso and legs of the user.

2. Description of Related Art

A lot of patents addressing the function and structure of a bed for hospital patients are available to the public. Functionally, these beds all have one thing in common, that is to provide support to the torso and legs of a patient lying thereon. Normally, a foldable bed used for a patient has a handle, a shaft connected with the handle and a plurality of linkages pivotally connected with the shaft. When the handle is rotated, the shaft with thread formed thereon will be driven to rotate in the same direction as the handle. The rotation of the shaft will thus drive the rear portion and/or the front portion of the bed and cause them to be lifted upward. Because of the movement of the rear portion and the front portion of the bed, the torso and legs of the patient will be inclined upwardly either separately or simultaneously. The above mentioned structure can provide substantial support to the torso and legs of the patient. However, the operation of this type of bed requires that a person not in the bed manually turn the handle to adjust the bed. To rectify this shortcoming, a new structure was developed that has at least one motor mounted thereunder, so that the upward movement of the front and/or rear portion of the bed is driven by a motor that can be operated by the patient in the bed. The conventional mechanized bed increases the efficiency of providing support to the patient, however it is complex in structure and expensive.

The present invention aims to provide an improved a mechanized foldable bed to obviate and/or mitigate the aforementioned problems.

SUMMARY OF THE INVENTION

The main object of the present invention is to provide a mechanized foldable bed. The structure of the bed enables the front and rear portion of the bed to move simultaneously, so as to provide substantial support to a patient lying thereon.

Another object of the invention is to provide a pair of rollers on the rear end of the bed. The rollers are able to respectively roll on one of a pair of tracks that are securely mounted on the bed, such that the upward movement of the rear portion of the bed is smooth.

Therefore, the patient lying on the bed constructed in accordance with the present invention not only has substantial support to the torso and legs but is also moved smoothly movement while the rear portion of the bed is lifted upward.

In order to meet the above objectives, the foldable bed has a front frame assembly composed of a first frame member and a second frame member pivotally connected with the first frame member and a rear frame assembly composed of a third frame member and a fourth frame member pivotally connected with the third frame member. Furthermore, the foldable bed has a motor, a driving rod extendably connected with the motor, a first connecting rod pivotally connected with the driving rod, a second connecting rod pivotally connected with the first connecting rod and a tube securely mounted under the second frame assembly to receive the second connecting rod therethrough. The first frame member has a first connector securely connected thereunder and pivotally connected with the driving rod. The third frame member has a second connector securely connected thereunder and pivotally connected with the free end of the driven rod. When the motor is activated, the driving rod extends or retracts and the first and the second connectors will move accordingly, and the first frame member and the third frame member will be moved. Due to the movement of the first and third frame members, the torso and legs of the patient lying on the bed will be supported to move along with the first and the third frame members.

The detailed features of the present invention will be apparent in the detailed description with appropriate reference to the accompanying drawings.

DETAILED DESCRIPTION OF PREFERRED EMBODIMENT

Figure 1:
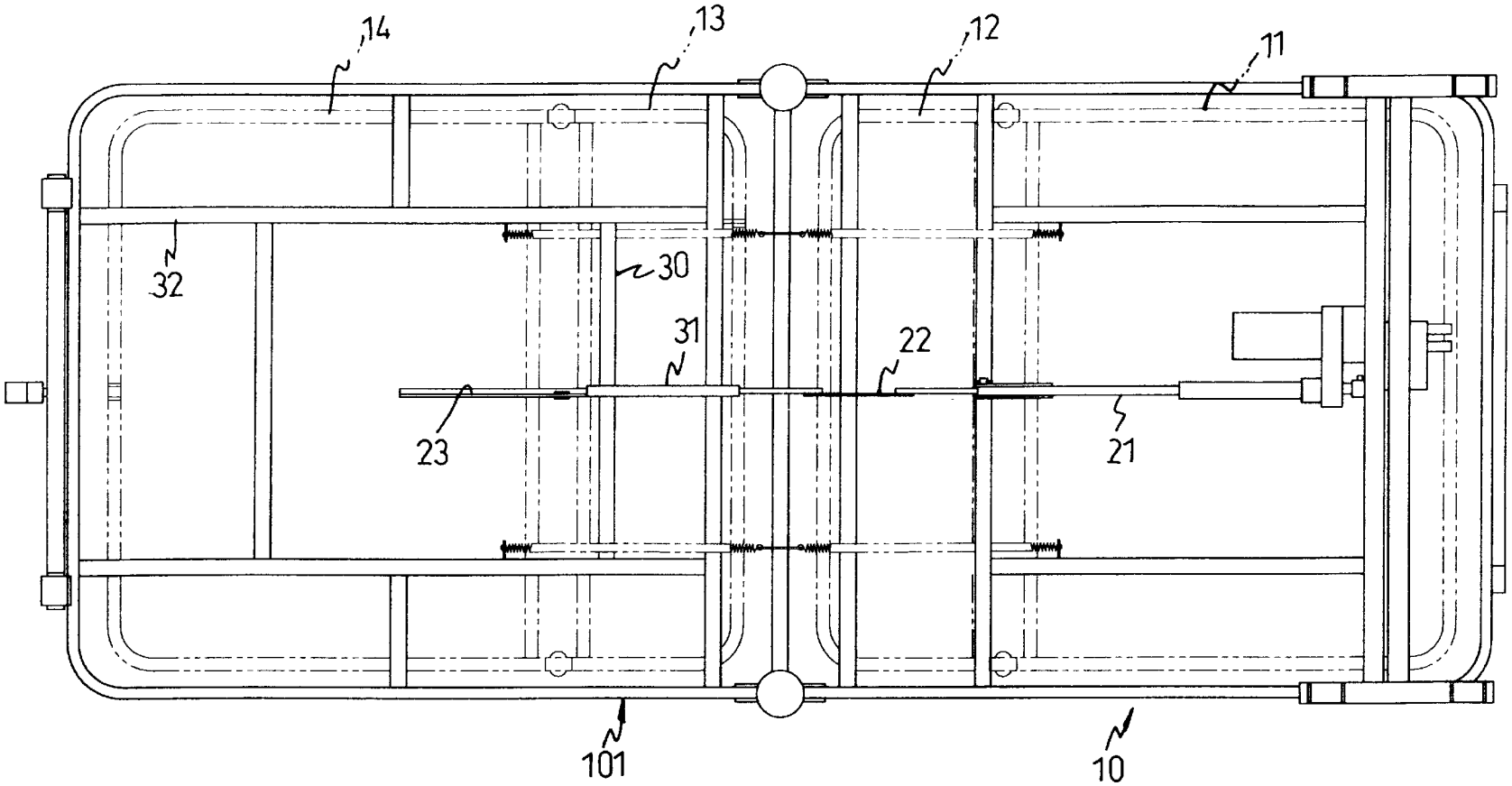
FIG. 1 is a bottom plan view showing the arrangement of the structure of the bed in accordance with the present invention.
Figure 2:
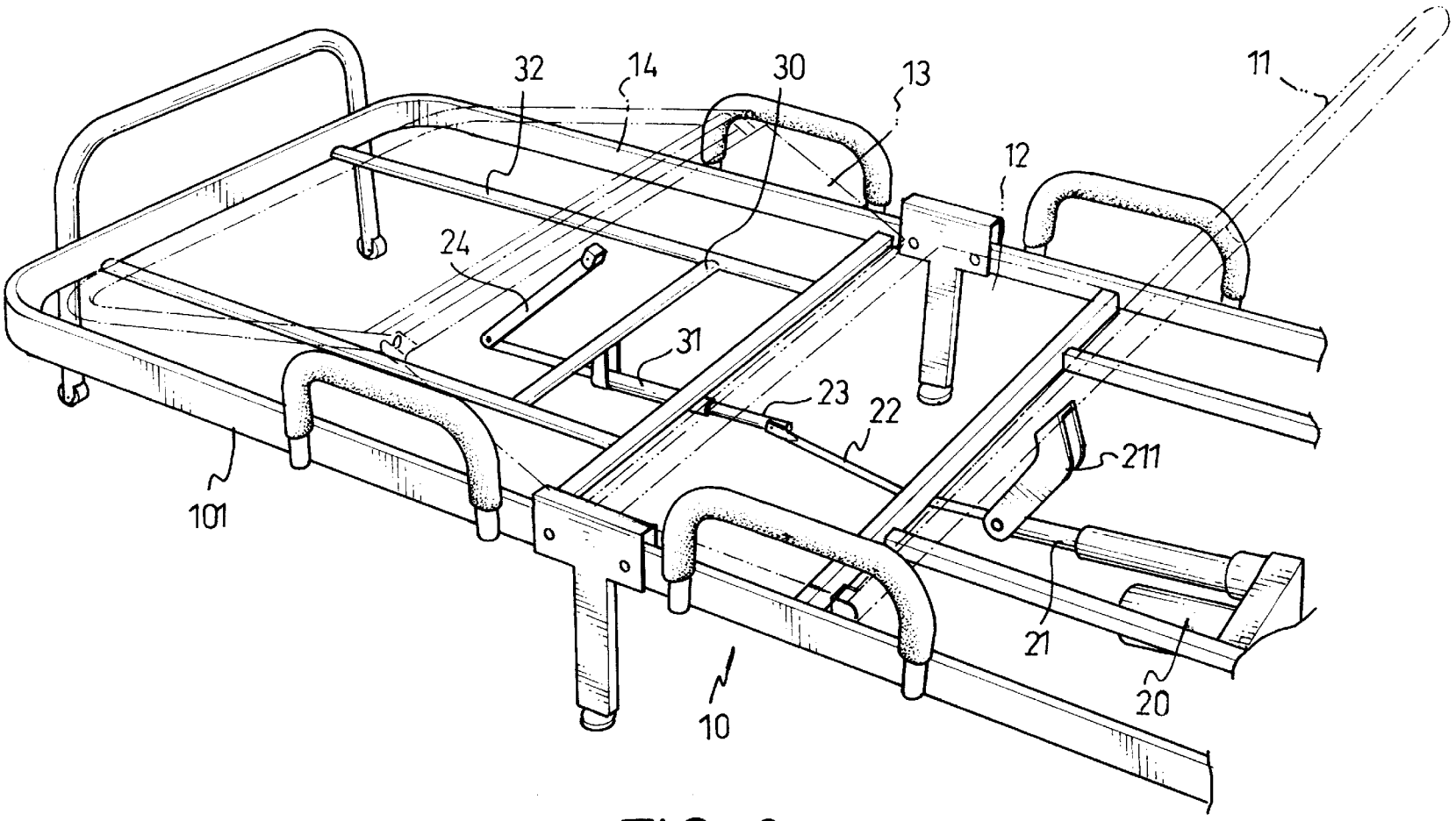
FIG. 2 is perspective view showing the structure and linkage mounted under the bed in accordance with the present invention.

The present invention relates to a mechanized foldable bed. Referring to FIGS. 1 and 2, the foldable bed has a front frame assembly (10) composed of a first frame member (11) and a second frame member (12) pivotally connected with the first frame member (11) and a rear frame assembly (101) composed of a third frame member (13) and a fourth frame member (14) pivotally connected with the third frame member (13). Furthermore, the foldable bed has a motor (20), a driving rod (21) extendably connected with the motor (20), a first connecting rod (22) pivotally connected with the driving rod (21), a second connecting rod (23) pivotally connected with the first connecting rod (22) and a tube (31) securely mounted under the rear frame assembly (101) for receiving the second connecting rod (23) therethrough. The first frame member (11) has a first connector (211) securely connected thereunder and pivotally connected with the driving rod (21). The third frame member (13) has a second connector (24) pivotally connected thereunder and pivotally connected with the free end of the second connecting rod (23).

Figure 3:
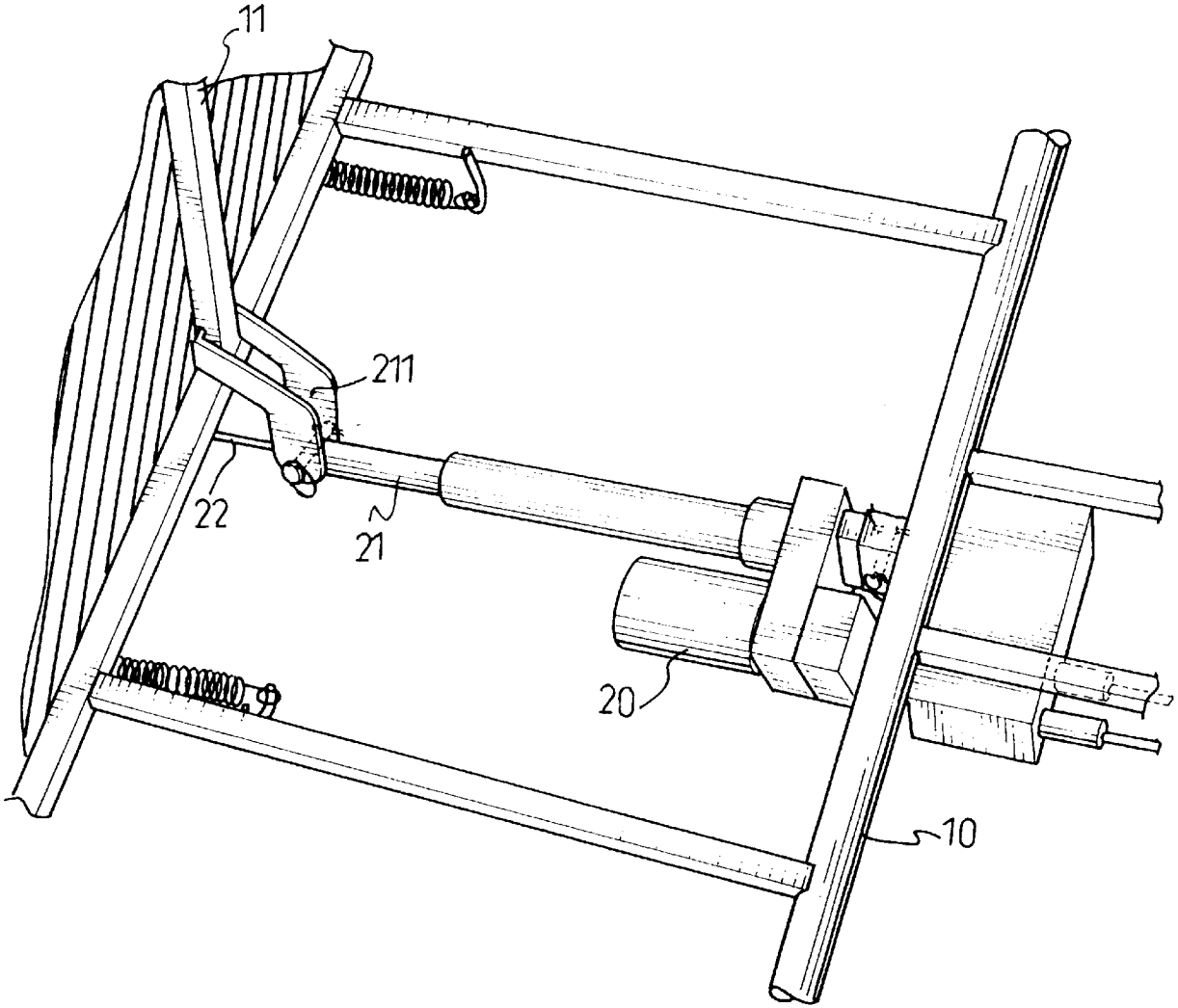
FIG. 3 is an enlarged perspective view of the connection between the motor and the first connector in accordance with the present invention.

As shown in FIGS. 2 and 3, one end of the first connector (211) is securely connected under the first frame member (11) and the other end thereof is pivotally connected with the driving rod (21), such that when the driving rod (21) extends or retracts, the first frame member (11) is able to incline upward or downward with respect to the second frame member (12). Because of the pivotal connection between the first connecting rod (22) and the second connecting rod (23) and the limitation of the tube (31), the second connecting rod (23) is able to initiate the inclined movement of the third frame member (13) with respect to the fourth frame member (14).

Figure 4:
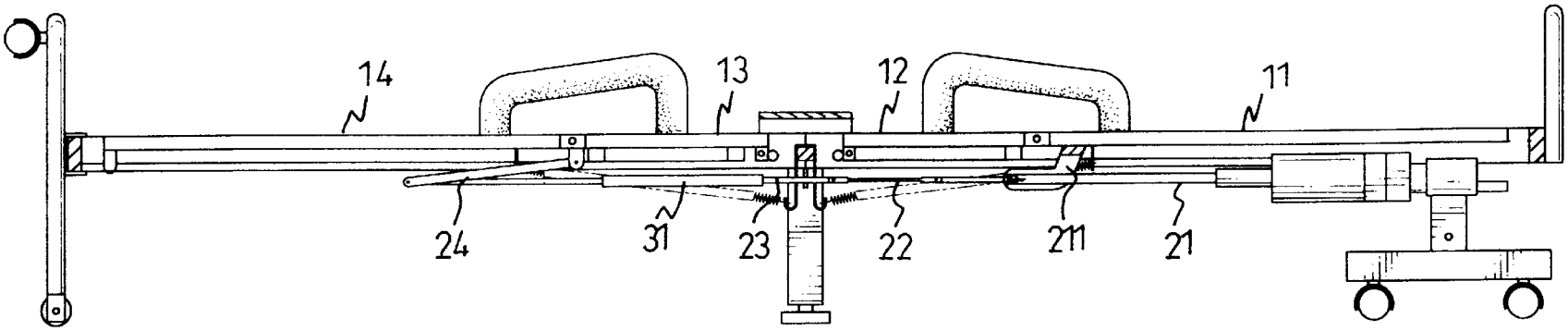
FIG. 4 is a side view of the bed in accordance with the present invention.
Figure 5:
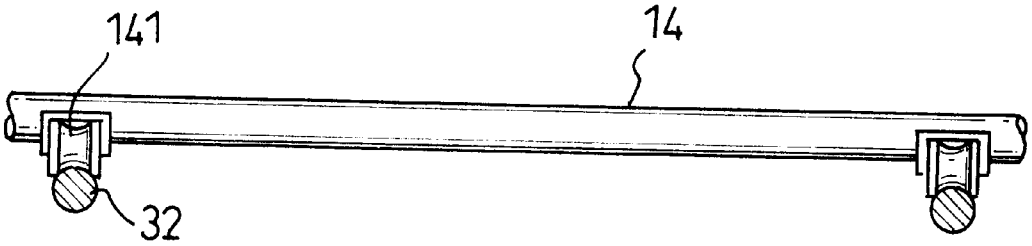
FIG. 5 is a schematic view showing the relationship between the rollers and the tracks of the bed in accordance with the present invention.

Referring to FIG. 4, when the bed is fully reclined, the first, second, third and fourth frame members (11, 12, 13, 14) are flat with respect to each other, accordingly, the driving rod (21), the first connecting rod (22) and the third connecting rod (23) are all in line with each other. With such an arrangement, a patient is able to lie thereon comfortably. As shown in FIG. 5, a pair of rollers (141) are rotatably mounted on the free end of the fourth frame member (14). The rollers (141) are respectively movably mounted on one of a pair of tracks (32) which together with the tube (31) form a frame (30) securely located under the third and the fourth frame members (13, 14).

Figure 6:
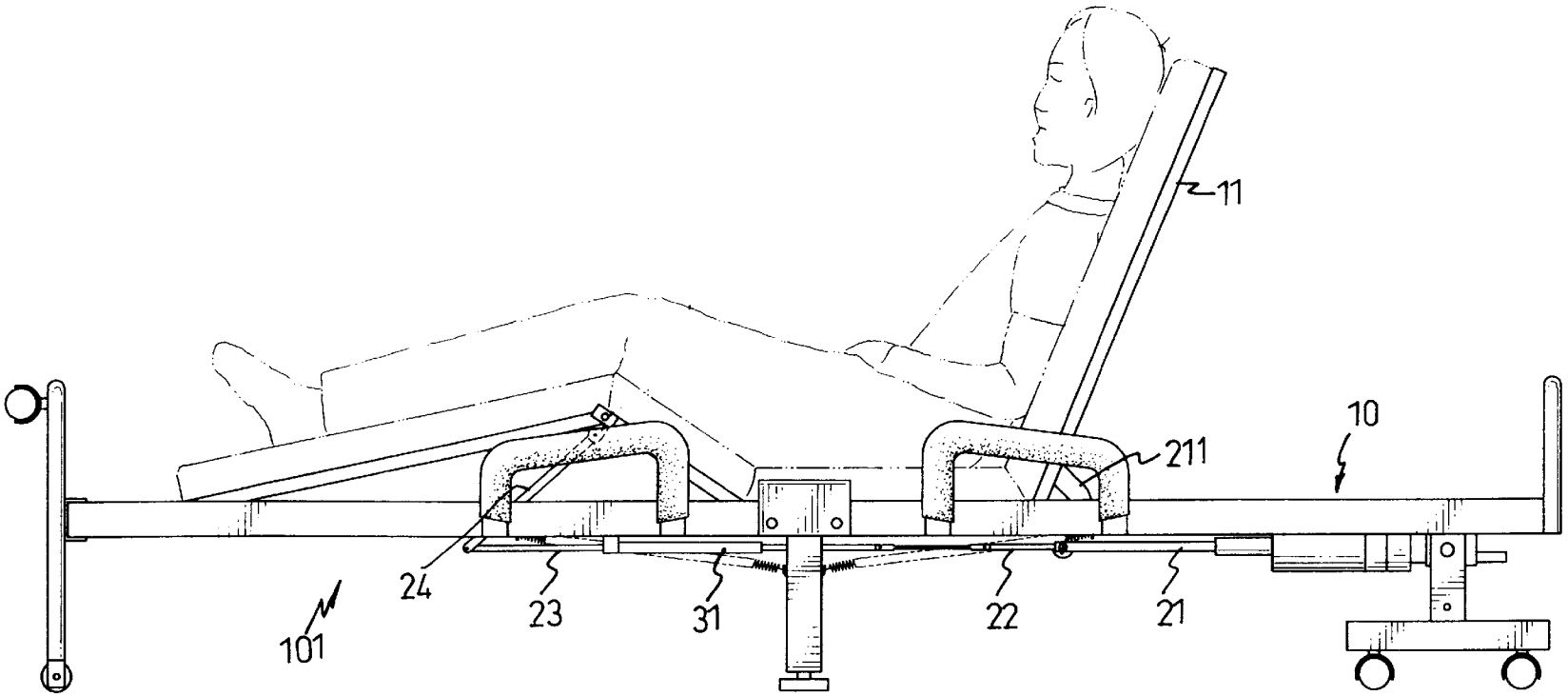
FIG. 6 is a side plan view showing the structure and linkages of the foldable bed in accordance with the present invention in an inclined state.

Referring to FIG. 6 and taking FIG. 2 for reference, when the motor (20) is activated and the driving rod (21) which is extendably connected with the motor (20) is retracted with respect to the motor (20), the first connector (211) will then drive the first frame member (11) to incline with respect to the second frame member (12). Meanwhile, due to the connection between the first and second connecting rods (22, 23), the third frame member (13) is driven to incline with respect to the second frame member (12) as well. Therefore, when the first and the third frame members (11, 13) are inclined with respect to the second frame member (12), the torso and the legs of a patient are supported simultaneously. To enhance the smooth movement of the fourth frame member (14) on the frame (30), the rollers (141) movably mounted on the tracks (32) enable the movement of the fourth frame member (14) with respect to the frame (30) to be smooth.

Figure 7:
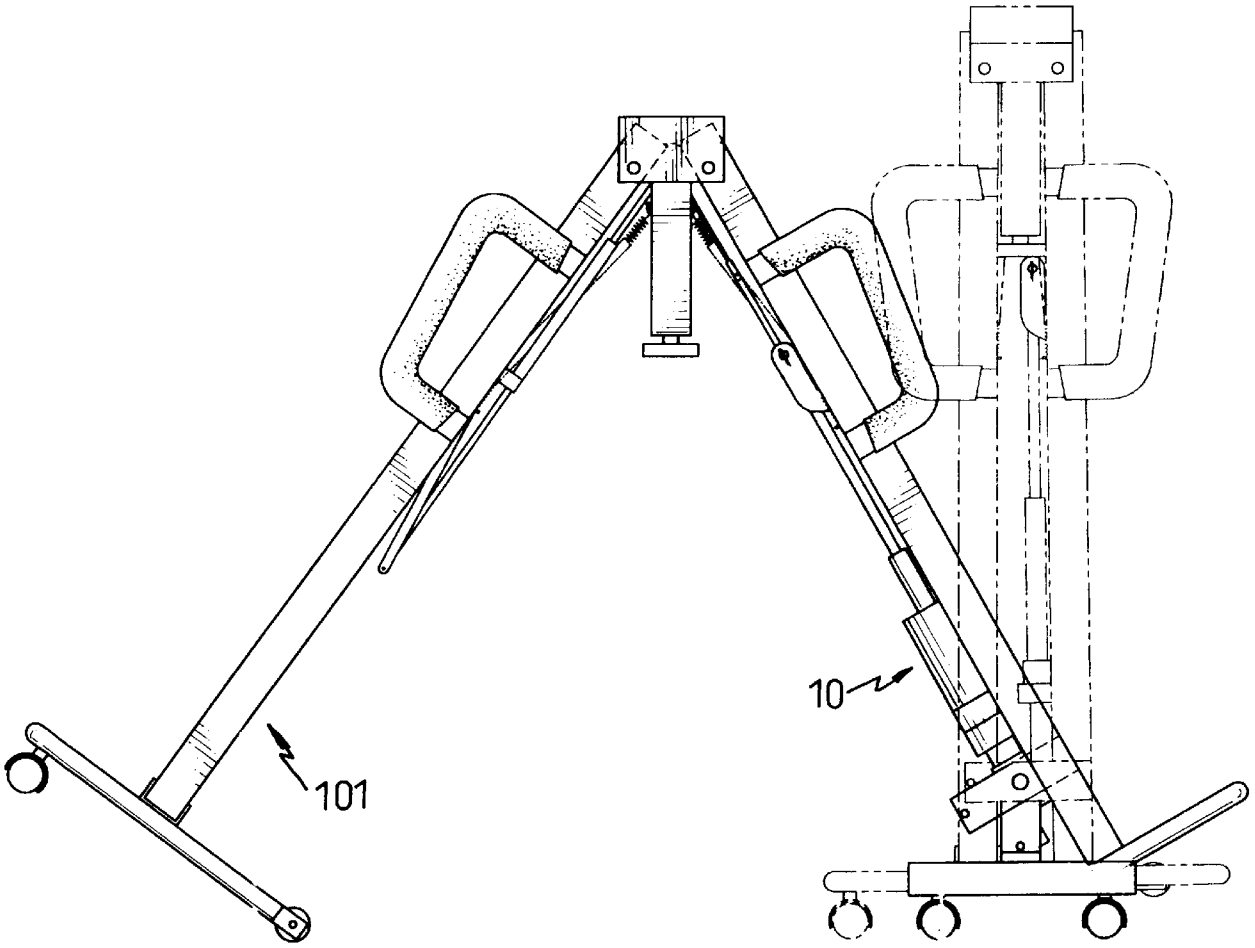
FIG. 7 is a side plan view showing the folding of the foldable bed in accordance with the present invention.

FIG. 7 shows that when the bed constructed in accordance with the invention is not in use, an operator is able to fold the bed to reduce the space used. That is, the front frame assembly (10) and the rear frame assembly (101) are able to be folded together by the pivotal connection therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mechanized foldable bed having a front frame assembly (10) composed of a first frame member (11) and a second frame member (12) pivotally connected with the first frame member (11) and a rear frame assembly (101) composed of a third frame member (13) pivotally connected with the second frame member (12) and a fourth frame member (14) pivotally connected with the third frame member (13), the structure comprising:

a motor (20) securely mounted under the bed;

a driving rod (21) extendably connected with the motor (20);

a first connecting rod (22) pivotally connected with the driving rod (21);

a second connecting rod (23) pivotally connected with the first connecting rod (22);

a tube (31) securely connected with the bed for receiving the second connecting rod (23) therethrough;

a first connector (211) securely connected under the first frame member (11) and pivotally connected with the driving rod (21); and a second connector (24) pivotally connected under the third frame member (13) and with the second connecting rod (23).

2. The structure as claimed in claim 1, wherein a pair of rollers (141) are rotatably mounted on the end of the fourth frame member (14).

3. The structure as claimed in claim 2, wherein a pair of tracks (32) are provided under the bed for the rollers (141) to roll thereon.

* * * * *